US006086072A

United States Patent [19]

Prus

[11] Patent Number: 6,086,072

[45] Date of Patent: Jul. 11, 2000

[54] IN-LINE SKATE SUSPENSION SYSTEM

[76] Inventor: Robert S. Prus, 2630 Vermillion Rd., Seabrook, Tex. 77586

[21] Appl. No.: 09/160,166

[22] Filed: Sep. 25, 1998

[51] Int. Cl.[7] ..... A63C 1/24

[52] U.S. Cl. ..... 280/11.28; 280/124.102; 280/11.22

[58] Field of Search ..... 280/11.22, 11.28, 280/11.27, 124.129, 124.102, 124.128, 124.153

[56] References Cited

U.S. PATENT DOCUMENTS

| | | | |
|---|---|---|---|
| 301,522 | 7/1884 | Richardson | 280/11.28 |
| 337,205 | 3/1886 | Shute | 280/11.28 |
| 3,979,842 | 9/1976 | Texidor | 280/280 |
| 5,082,300 | 1/1992 | Cucurullo | 280/11.28 |
| 5,085,445 | 2/1992 | Boyden | 280/11.22 |
| 5,405,156 | 4/1995 | Gonella | 280/11.28 |
| 5,503,413 | 4/1996 | Belogour | 280/11.22 |
| 5,511,805 | 4/1996 | McGrath | 280/11.22 |
| 5,582,418 | 12/1996 | Closser | 280/11.22 |
| 5,630,598 | 5/1997 | Zorzi et al. | 280/11.28 |
| 5,676,218 | 10/1997 | Hirose | 180/181 |
| 5,785,327 | 7/1998 | Gallant | 280/11.27 |
| 5,882,018 | 3/1999 | Petrosino | 280/7.13 |

FOREIGN PATENT DOCUMENTS

| | | | |
|---|---|---|---|
| WO92/10251 | 6/1992 | European Pat. Off. | 280/11.27 |
| WO93/12846 | 7/1993 | European Pat. Off. | 280/11.225 |
| WO93/12847 | 7/1993 | European Pat. Off. | 280/11.28 |
| 559179-A1 | 9/1993 | European Pat. Off. | 280/11.225 |
| 419948 | 9/1910 | France | 280/11.28 |
| 307846 | 9/1918 | Germany | 280/11.28 |

*Primary Examiner*—Brian L. Johnson
*Assistant Examiner*—Gerald Klebe

[57] ABSTRACT

An in-line skate suspension system for absorbing shocks when travelling over a ground surface. The suspension system includes a housing attached to a sole of an in-line skate boot with a mounting bar provided therein. An elongate tension rod is rotatably mounted in the housing. The tension rod has a pair of spaced apart threaded portions thereon. A pair of tension members each having a threaded bore therethrough are threaded onto the threaded portions of the tension rod. Each of the tension members has downwardly extending lower arm pivotally coupled thereto. The lower arms of the tension members are also pivotally coupled to the mounting bar. A plurality of spaced apart wheel assemblies downwardly depend from the mounting bar. Each wheel assembly comprises a ground engaging wheel, an axle, a pivot arm, an extent and a spring.

6 Claims, 2 Drawing Sheets

IN-LINE SKATE SUSPENSION SYSTEM

BACKGROUND OF THE INVENTION

1. Field of the Invention

The present invention relates to in-line skate suspension systems and more particularly pertains to a new in-line skate suspension system for absorbing shocks when travelling over a ground surface.

2. Description of the Prior Art

The use of in-line skate suspension systems is known in the prior art. More specifically, in-line skate suspension systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,915,399; U.S. Pat. No. 5,551,713; U.S. Pat. No. 5,330,208; U.S. Pat. No. 2,689,743; U.S. Pat. No. 2,558,696; and U.S. Pat. No. Des. 377,820.

While these devices fulfill their respective, particular objectives and requirements, the aforementioned patents do not disclose a new in-line skate suspension system. The inventive device includes a housing attached to a sole of an in-line skate boot with a mounting bar provided therein. An elongate tension rod is rotatably mounted in the housing. The tension rod has a pair of spaced apart threaded portions thereon. A pair of tension members each having a threaded bore therethrough are threaded onto the threaded portions of the tension rod. Each of the tension members has downwardly extending lower arm pivotally coupled thereto.

The lower arms of the tension members are also pivotally coupled to the mounting bar. A plurality of spaced apart wheel assemblies downwardly depend from the mounting bar. Each wheel assembly comprises a ground engaging wheel, an axle, a pivot arm, an extent and a spring.

In these respects, the in-line skate suspension system according to the present invention substantially departs from the conventional concepts and designs of the prior art, and in so doing provides an apparatus primarily developed for the purpose of absorbing shocks when travelling over a ground surface.

SUMMARY OF THE INVENTION

In view of the foregoing disadvantages inherent in the known types of in-line skate suspension systems now present in the prior art, the present invention provides a new in-line skate suspension system construction wherein the same can be utilized for absorbing shocks when travelling over a ground surface.

The general purpose of the present invention, which will be described subsequently in greater detail, is to provide a new in-line skate suspension system apparatus and method which has many of the advantages of the in-line skate suspension systems mentioned heretofore and many novel features that result in a new in-line skate suspension system which is not anticipated, rendered obvious, suggested, or even implied by any of the prior art in-line skate suspension systems, either alone or in any combination thereof.

To attain this, the present invention generally comprises a housing attached to a sole of an in-line skate boot with a mounting bar provided therein. An elongate tension rod is rotatably mounted in the housing. The tension rod has a pair of spaced apart threaded portions thereon. A pair of tension members each having a threaded bore therethrough are threaded onto the threaded portions of the tension rod. Each of the tension members has downwardly extending lower arm pivotally coupled thereto. The lower arms of the tension members are also pivotally coupled to the mounting bar. A plurality of spaced apart wheel assemblies downwardly depend from the mounting bar. Each wheel assembly comprises a ground engaging wheel, an axle, a pivot arm, an extent and a spring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new in-line skate suspension system apparatus and method which has many of the advantages of the in-line skate suspension systems mentioned heretofore and many novel features that result in a new in-line skate suspension system which is not anticipated, rendered obvious, suggested, or even implied by any of the prior art in-line skate suspension systems, either alone or in any combination thereof.

It is another object of the present invention to provide a new in-line skate suspension system which may be easily and efficiently manufactured and marketed.

It is a further object of the present invention to provide a new in-line skate suspension system which is of a durable and reliable construction.

An even further object of the present invention is to provide a new in-line skate suspension system which is susceptible of a low cost of manufacture with regard to both materials and labor, and which accordingly is then susceptible of low prices of sale to the consuming public, thereby making such in-line skate suspension system economically available to the buying public.

Still yet another object of the present invention is to provide a new in-line skate suspension system which provides in the apparatuses and methods of the prior art some of the advantages thereof, while simultaneously overcoming some of the disadvantages normally associated therewith.

Still another object of the present invention is to provide a new in-line skate suspension system for absorbing shocks when travelling over a ground surface.

Yet another object of the present invention is to provide a new in-line skate suspension system which includes a housing attached to a sole of an in-line skate boot with a mounting bar provided therein. An elongate tension rod is rotatably mounted in the housing. The tension rod has a pair of spaced apart threaded portions thereon. A pair of tension members each having a threaded bore therethrough are threaded onto the threaded portions of the tension rod. Each of the tension members has downwardly extending lower arm pivotally coupled thereto. The lower arms of the tension members are also pivotally coupled to the mounting bar. A plurality of spaced apart wheel assemblies downwardly depend from the mounting bar. Each wheel assembly comprises a ground engaging wheel, an axle, a pivot arm, an extent and a spring.

Still yet another object of the present invention is to provide a new in-line skate suspension system that reduces foot fatigue from shocks when using in-line skates.

Even still another object of the present invention is to provide a new in-line skate suspension system that enhances user control when in-line skating.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
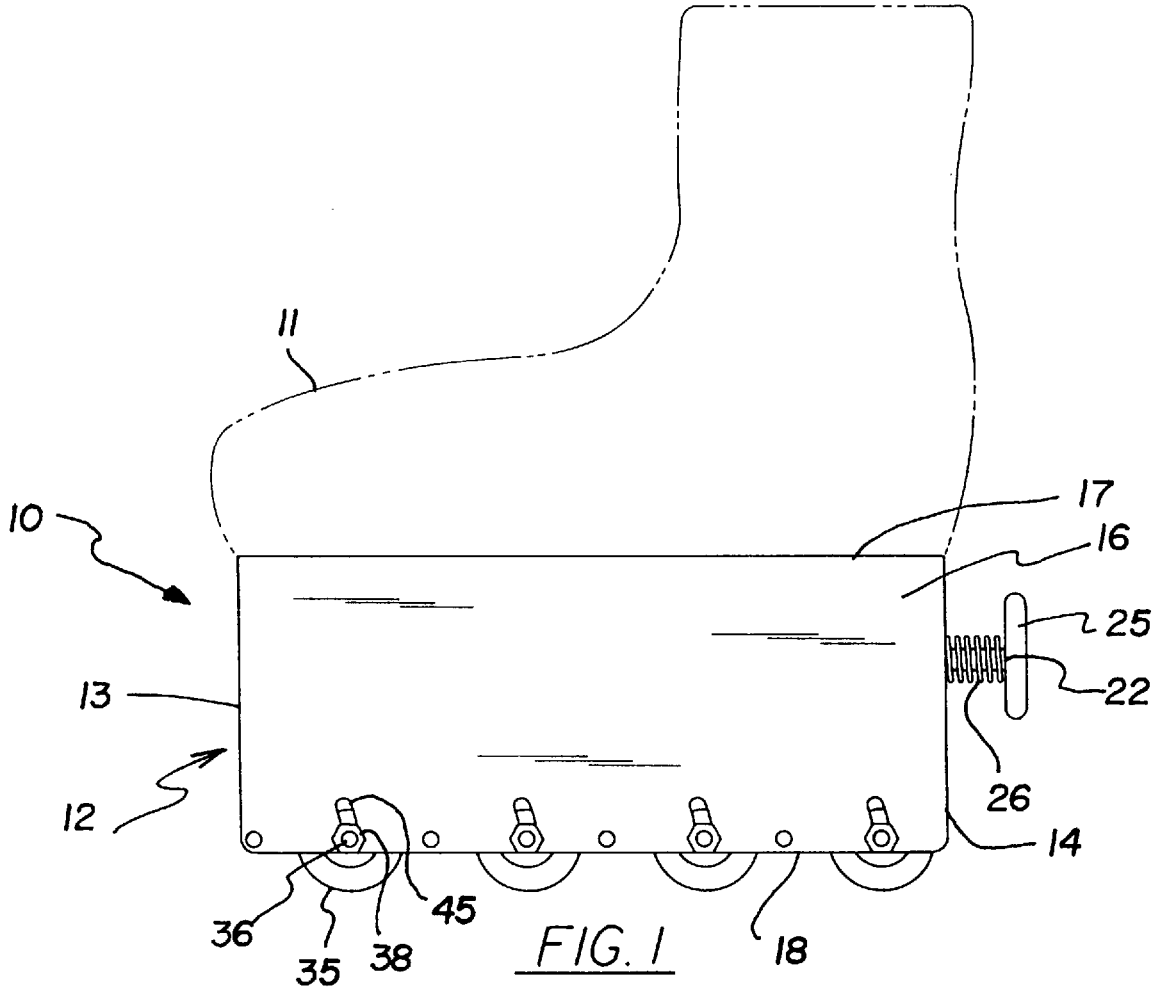
FIG. 1 is a schematic side view of a new in-line skate suspension system according to the present invention.
Figure 2:
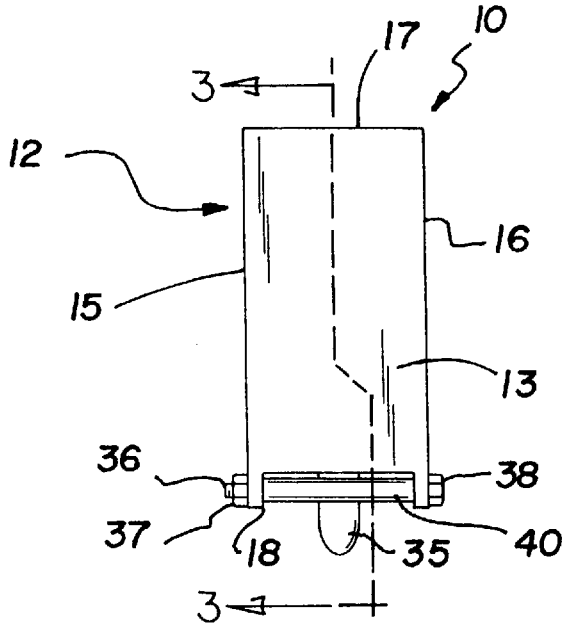
FIG. 2 is a schematic front end view of the present invention.

With reference now to the drawings, and in particular to FIGS. 1 through 6 thereof, a new in-line skate suspension system embodying the principles and concepts of the present invention and generally designated by the reference numeral 10 will be described.

As best illustrated in FIGS. 1 through 6, the in-line skate suspension system 10 generally comprises a housing 12 attached to a sole of an in-line skate 11 boot with a mounting bar 19 provided therein. An elongate tension rod 20 is rotatably mounted in the housing 12. The tension rod 20 has a pair of spaced apart threaded portions 27,28 thereon. A pair of tension members 29,30 each having a threaded bore therethrough are threaded onto the threaded portions 27,28 of the tension rod 20. Each of the tension members 29,30 has downwardly extending lower arm 31 pivotally coupled thereto. The lower arms 31 of the tension members 29,30 are also pivotally coupled to the mounting bar 19. A plurality of spaced apart wheel assemblies 34*a*,34*b*,34*c*,34*d* downwardly depend from the mounting bar 19. Each wheel assembly 34*a*,34*b*,34*c*,34*d* comprises a ground engaging wheel 35, an axle 36, a pivot arm 40, an extent 43 and a spring 44.

In closer detail, the housing 12 has a front wall 13, a back wall 14, a pair of spaced apart side walls 15,16 extending between the front and back walls 13,14 of the housing 12, a top 17, and an open bottom 18. The top 17 of the housing 12 is adapted for attachment to a sole of an in-line skate boot 11. The housing 12 is preferably generally rectangular in configuration so that the front and back walls 13,14 of the housing 12 generally lie in vertical planes generally parallel to one another and the side walls 15,16 of the housing 12 generally lie in generally parallel vertical planes to one another and generally perpendicular to the planes of the front and back walls 13,14.

The elongate mounting bar 19 is provided in the housing 12. The mounting bar 19 has a pair of opposite ends, and a longitudinal axis extending between the ends of the mounting bar 19. The longitudinal axis of the mounting bar 19 extends between the front and back walls 13,14 of the housing 12 so that one of the ends of the mounting bar 19 is positioned adjacent the front wall 13 of the housing 12 and another of the ends of the mounting bar 19 is positioned adjacent the back wall 14 of the housing 12. Preferably, the longitudinal axis of the mounting bar 19 lies in a horizontal plane generally parallel to the top 17 of the housing 12.

The elongate tension rod 20 is also provided in the housing 12. The tension rod 20 has opposite front and back ends 21,22 and a longitudinal axis extending between the ends 21,22 of the tension rod 20. The back end 22 of the tension rod 20 is outwardly extended through the back wall 14 of the housing 12 with the tension rod 20 rotationally mounted to the back wall 14 of the housing 12 by extension through a bearing 24 to permit rotation of the tension rod 20 about the longitudinal axis of the tension rod 20. The front end 21 of the tension rod 20 is rotatably mounted to the front wall 13 of the housing 12 by extension into another bearing 23 on the front wall 13 to permit rotation of the tension rod 20 about the longitudinal axis of the tension rod 20.

Preferably, the back end 22 of the tension rod 20 has a turn handle 25 extending generally perpendicular to the longitudinal axis of the tension rod 20. The turn handle 25 is designed for permitting a user to easily rotate the tension rod 20 about the longitudinal axis of the tension rod 20. Ideally, the tension rod 20 has a spring 26 disposed therearound positioned between the back wall 14 of the housing 12 and the turn handle 25. The spring 26 biases the tension rod 20 in an outwards direction from the back wall 14 of the housing 12.

The tension rod 20 also has a pair of spaced apart threaded portions 27,28 thereon. A pair of tension members 29,30 each have a threaded bore therethrough through which the tension rod 20 is extended through. The bore of one of the tension members 29 is threaded onto a first of the threaded portions 27 of the tension rod 20 while the bore of another of the tension members 30 is threaded onto a second of the threaded portions 28 of the tension rod 20. In use, rotation of the tension rod 20 in a first direction advances the tension members 29,30 on the tension rod 20 towards the front wall 13 of the housing 12. Conversely, rotation of the tension rod 20 in an opposite second direction advances the tension members 29,30 on the tension rod 20 towards the back wall 14 of the housing 12.

Each of the tension members 29,30 has downwardly extending lower arm 31. One end 32 of each lower arm 31 is pivotally coupled thereto while the other ends 33 of the lower arms 31 are pivotally coupled to the mounting bar 19. In use, advancing the tension members 29,30 in one direction on the tension rod 20 causes the lower arms 31 to push the mounting bar 19 downwards. Advancing the tension members 29,30 in the opposite direction on the tension rod 20 causes the lower arms 31 to move the mounting bar 19 upwards.

A plurality of spaced apart wheel assemblies 34*a*,34*b*, 34*c*,34*d* downwardly depend from the mounting bar 19. The wheel assemblies 34*a*,34*b*,34*c*,34*d* are preferably arranged in a row along the mounting bar 19 extending between the ends of the mounting bar 19. Ideally, the wheel assemblies 34*a*,34*b*,34*c*,34*d* are spaced apart at generally equal intervals in the row along the mounting bar 19.

Each wheel assembly 34*a*,34*b*,34*c*,34*d* comprises a ground engaging wheel 35, a pivot arm 40, a spring 44, and an extent 43. The ground engaging wheel 35 is rotatably mounted on an axle 36 to permit free rotation of the wheel 35 with a portion of the wheel downwardly extending from the bottom 18 of the housing 12. The housing 12 has a pair of opposing slots 45 in the side walls 15,16 of the housing 12 for each wheel assembly 34*a*,34*b*,34*c*,34*d*. The slots 45 are positioned towards the bottom 18 of the housing 12 and beneath the mounting bar 19. Each of the slots 45 has a length generally extending between the top 17 and bottom 18 of the housing 12. The axle 36 is extended between the side walls 15,16 of the housing 12 and through the associated pair of slots 45 of the housing 12 to permit travelling by the axle 36 up and down along the lengths of the associated pair of slots 45 of the housing 12 such as when the wheel travels over a bump or other protrusion extending from the traveled ground surface.

Figure 6:
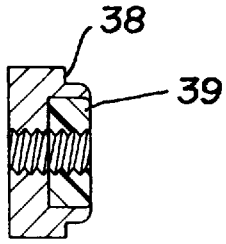
FIG. 6 is a schematic cross sectional view of an ideal nut used to secure the axles of the wheel assemblies to the housing of the present invention.
Figure 3:
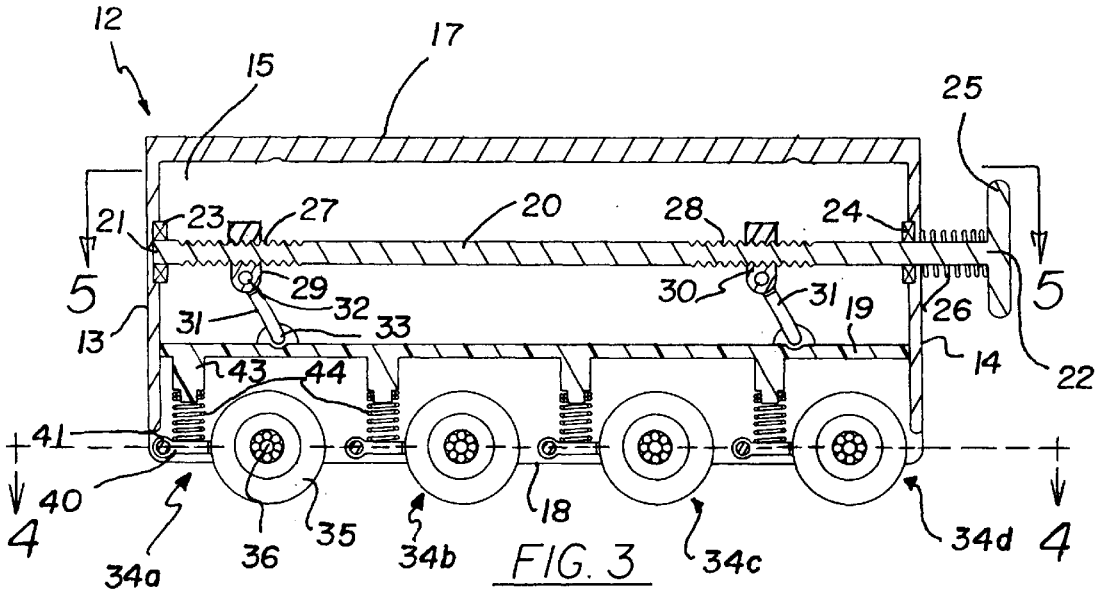
FIG. 3 is a schematic cross sectional view of the present invention taken from line 3—3 of FIG. 2.
Figure 4:
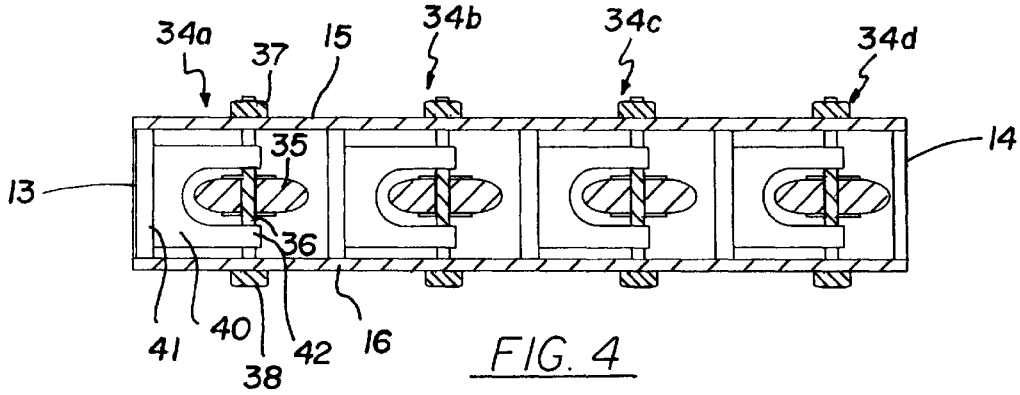
FIG. 4 is a schematic bottom side view of the present invention.
Figure 5:
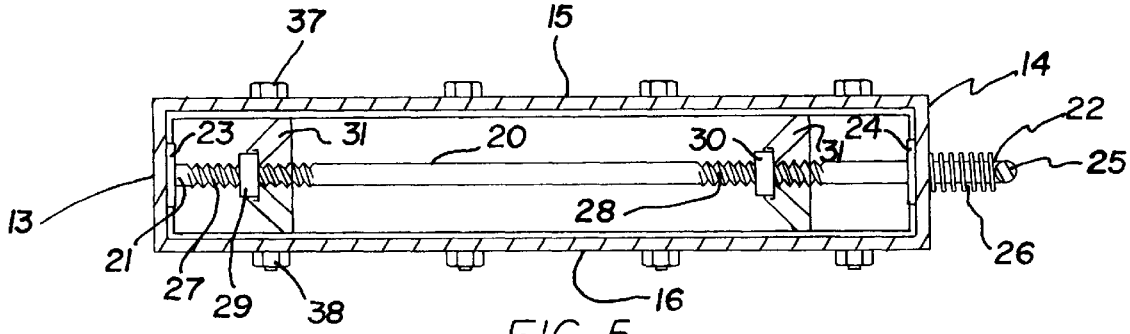
FIG. 5 is a schematic cross sectional view of the present invention taken from line 5—5 of FIG. 4.

The axle 36 has a pair of opposite threaded ends. One of the ends of the axle 36 outwardly extends from one of the side walls of the housing 12 while the other end of the axle 36 outwardly extends from the other side wall of the housing 12. Each end of the axle 36 has a threaded nut 37,38 threaded thereon to hold the axle 36 to the housing 12 while still permitting moving of the axle 36 in the slots 45. As illustrated in FIG. 6, ideally, each of the nuts 37,38 comprises a lock-nut having an inner lining 39 to help prevent the nut 37,38 from coming loose from the axle 36 from vibrations or stress during use.

The pivot arm 40 is pivotally coupled to the side walls 15,16 of the housing 12 between the mounting bar 19 and the bottom 18 of the housing 12. The pivot arm 40 is mounted to the axle 36 to permit free rotation of the axle 36. In use, the pivot arm 40 is correspondingly pivoted up and down when the axle 36 travels up and down in the associated pair of slots 45 of the housing 12 when the wheel goes of a bump on the ground surface. The extent 43 is downwardly extended from the mounting bar 19 towards the pivot arm 40. The spring 44 is interposed between the extent 43 and the pivot arm 40, the spring biasing the pivot arm 40 and therefore the axle 36 in a downwards direction towards the ground surface.

In use, moving the mounting bar 19 downwards by the lower arms 31 compresses the springs of the wheel assemblies 34*a*,34*b*,34*c*,34*d* to make a stiffer ride by making the wheels less easily pivotable over a bump. Raising the mounting bar 19 by the lower arms 31 relaxes the spring to make a softer ride by making the wheels more easily pivotable over a bump and thereby absorb the shock of the bump before it is transferred to the foot of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suspension system for an in-line skate, comprising:

a housing having a front wall, a back wall, a pair of spaced apart side walls extending between said front and back walls of said housing, a top, and an open bottom;

said top of said housing being adapted for attachment to a sole of an in-line skate boot;

an elongate mounting bar being provided in said housing, said mounting bar having a pair of opposite ends, and a longitudinal axis extending between said ends of said mounting bar;

said longitudinal axis of said mounting bar extending between said front and back walls of said housing such that one of said ends of said mounting bar is positioned adjacent said front wall of said housing and another of said ends of said mounting bar is positioned adjacent said back wall of said housing;

an elongate tension rod being provided in said housing, said tension rod having opposite front and back ends and a longitudinal axis extending between said ends of said tension rod;

said back end of said tension rod being outwardly extended through said back wall of said housing, said tension rod being rotationally mounted to said back wall of said housing to permit rotation of said tension rod about said longitudinal axis of said tension rod;

said front end of said tension rod being rotatably mounted to said front wall of said housing to permit rotation of said tension rod about said longitudinal axis of said tension rod;

said tension rod having a pair of spaced apart threaded portions thereon;

a pair of tension members each having a threaded bore therethrough, said tension rod being extended through said bores of said tension members, said bore of one of said tension members being threaded onto a first of said threaded portions of said tension rod, said bore of another of said tension members being threaded onto a second of said threaded portions of said tension rod;

each of said tension members having downwardly extending lower arm pivotally coupled thereto, said lower arms of said tension members being pivotally coupled to said mounting bar;

a plurality of spaced apart wheel assemblies downwardly depending from said mounting bar;

said housing having a pair of opposing slots in said side walls of said housing for each wheel assembly, said slots being positioned towards said bottom of said housing, each of said slots having a length generally extending between said top and bottom of said housing; and each wheel assembly comprising:

a ground engaging wheel, an axle, a pivot arm, an extent and a spring;

said ground engaging wheel being rotatably mounted on said axle to permit free rotation of said wheel , a portion of said wheel downwardly extending from said bottom of said housing;

said axle being extended between said side walls of said housing and through the associated pair of slots of said housing to permit travelling by said axle along the lengths of the associated pair of slots of said housing;

said pivot arm being pivotally coupled to said side walls of said housing between said mounting bar and said bottom of said housing, said pivot arm being mounted to said axle to permit free rotation of said axle;

said extent being downwardly extended from said mounting bar towards said pivot arm; and said spring being interposed between said extent and said pivot arm, said spring biasing said pivot arm and said axle in a downwards direction.

2. The suspension system of claim 1, wherein said housing is generally rectangular in configuration, said front and back walls of said housing generally lying in planes generally parallel to one another, said side walls of said housing generally lying in generally parallel planes to one another and generally perpendicular to said planes of said front and back walls.

3. The suspension system of claim 1, wherein said longitudinal axis of said mounting bar generally lies in a plane generally parallel to said top of said housing.

4. The suspension system of claim 1, wherein said back end of said tension rod has a turn handle, and wherein said tension rod has a spring disposed therearound and positioned between said back wall of said housing and said turn handle, said spring biasing said tension rod in an outwards direction from said back wall of said housing.

5. The suspension system of claim 1, wherein said wheel assemblies are arranged in a row along said mounting bar extending between said ends of said mounting bar, said wheel assemblies being spaced apart at generally equal intervals in said row along said mounting bar.

6. A suspension system for an in-line skate, comprising:

a housing having a front wall, a back wall, a pair of spaced apart side walls extending between said front and back walls of said housing, a top, and an open bottom;

said top of said housing being adapted for attachment to a sole of an in-line skate boot;

said housing being generally rectangular in configuration, said front and back walls of said housing generally lying in planes generally parallel to one another, said side walls of said housing generally lying in generally parallel planes to one another and generally perpendicular to said planes of said front and back walls;

an elongate mounting bar being provided in said housing, said mounting bar having a pair of opposite ends, and a longitudinal axis extending between said ends of said mounting bar;

said longitudinal axis of said mounting bar extending between said front and back walls of said housing such that one of said ends of said mounting bar is positioned adjacent said front wall of said housing and another of said ends of said mounting bar is positioned adjacent said back wall of said housing;

said longitudinal axis of said mounting bar lying in a plane generally parallel to said top of said housing;

an elongate tension rod being provided in said housing, said tension rod having opposite front and back ends and a longitudinal axis extending between said ends of said tension rod;

said back end of said tension rod being outwardly extended through said back wall of said housing, said tension rod being rotationally mounted to said back wall of said housing to permit rotation of said tension rod about said longitudinal axis of said tension rod;

said front end of said tension rod being rotatably mounted to said front wall of said housing to permit rotation of said tension rod about said longitudinal axis of said tension rod;

said back end of said tension rod having a turn handle extending generally perpendicular to said longitudinal axis of said tension rod;

said tension rod having a spring disposed therearound and positioned between said back wall of said housing and said turn handle, said spring biasing said tension rod in an outwards direction from said back wall of said housing;

said tension rod having a pair of spaced apart threaded portions thereon;

a pair of tension members each having a threaded bore therethrough, said tension rod being extended through said bores of said tension members, said bore of one of said tension members being threaded onto a first of said threaded portions of said tension rod, said bore of another of said tension members being threaded onto a second of said threaded portions of said tension rod;

each of said tension members having downwardly extending lower arm pivotally coupled thereto, said lower arms of said tension members being pivotally coupled to said mounting bar;

a plurality of spaced apart wheel assemblies downwardly depending from said mounting bar, said wheel assemblies being arranged in a row along said mounting bar extending between said ends of said mounting bar, said wheel assemblies being spaced apart at generally equal intervals in said row along said mounting bar;

said housing having a pair of opposing slots in said side walls of said housing for each wheel assembly, said slots being positioned towards said bottom of said housing, each of said slots having a length generally extending between said top and bottom of said housing; and each wheel assembly comprising:

a ground engaging wheel, an axle, a pivot arm, an extent and a spring;

said ground engaging wheel being rotatably mounted on said axle to permit free rotation of said wheel, a portion of said wheel downwardly extending from said bottom of said housing;

said axle being extended between said side walls of said housing and through the associated pair of slots of said housing to permit travelling by said axle along the lengths of the associated pair of slots of said housing;

said axle having a pair of opposite threaded ends, one of said ends of said axle outwardly extending from one of said side walls of said housing, another of said ends of said axle outwardly extending from another of said side walls of said housing;

each end of said axle having a threaded nut threaded thereon;

said pivot arm being pivotally coupled to said side walls of said housing between said mounting bar and said bottom of said housing, said pivot arm being mounted to said axle to permit free rotation of said axle;

said extent being downwardly extended from said mounting bar towards said pivot arm; and said spring being interposed between said extent and said pivot arm, said spring biasing said pivot arm and said axle in a downwards direction.

* * * * *